US006312274B1

(12) United States Patent
Lin

(10) Patent No.: US 6,312,274 B1
(45) Date of Patent: Nov. 6, 2001

(54) ELECTRICAL CONNECTOR

(75) Inventor: Min-Shing Lin, Taipei (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 09/758,339

(22) Filed: Jan. 12, 2001

(51) Int. Cl.[7] ..... H01R 29/00
(52) U.S. Cl. ..... 439/188; 439/668; 439/669
(58) Field of Search ..... 439/188, 668, 439/669, 733.1, 108

(56) References Cited

U.S. PATENT DOCUMENTS 4,978,310 * 12/1990 Shichida ..... 439/668
5,092,795 * 3/1992 Kitagawa ..... 439/668
5,893,767 * 4/1999 Broschard, III ..... 439/668
6,000,970 * 12/1999 Wu ..... 439/668

* cited by examiner

*Primary Examiner*—Tho D. Ta
(74) *Attorney, Agent, or Firm*—Rosenberg, Klein & Lee

(57) ABSTRACT

An electrical connector comprises an insulating main body, a rear cover and a plurality of terminals. The insulating main body has an insertion slot for a plug and a plurality of embedding holes to retain the terminals within the main body. The electrical connector has simple assembling and the terminals are firmly and stably retained within the main body. Moreover, the plug has smooth operation and excellent contact with the electrical connector.

4 Claims, 4 Drawing Sheets

ELECTRICAL CONNECTOR

FIELD OF THE INVENTION

The present invention relates to an electrical connector, especially to an electrical connector, which has an insulating main body with a plurality of embedding holes, whereby the electrical connector is easily assembled, the terminals are firmed retained and the plug has smooth operation.

BACKGROUND OF THE INVENTION

The conventional electrical connector for communication device such as mobile phone is electrically connected to a circuit board in the mobile phone. More particularly, the electrical connector has an insertion socket containing a connecting plug to achieve electric connection. The electrical connector comprises an insulating main body and terminal assembled by lock-assembling or insertion groove assembling. However, above-mentioned two assembling methods are inconvenient. The lock assembling method has complicated process and mechanical fatigue is occurred between the insulating main body and terminal when the plug is repeatedly inserted and extracted. The insulating main body and terminal have not tight contact. Therefore, the plug will have not tight connection with the terminals and the signal transmission property is degraded. The insertion groove assembling method has simple assembling.

However, the terminals are not firmly retained within the insulating main body. Moreover, the plug is repeatedly interfered with the terminals, and the terminal is in contact with the cylindrical plug through the contact end on the elastic contact arm thereof. The conductive material on the terminal may be worn by repeated operation. The elastic contact arm of the terminals are also liable to loose its elasticity after repeated operation.

SUMMARY OF THE INVENTION

It is an object of the present invention to provide an electrical connector, which has an insulating main body with a plurality of embedding holes, whereby the electrical connector with various terminals is easily assembled. The terminals are firmed retained within the connector and easily interfered with each other. The insulating main body is provided with a rear cover to further retain the terminals.

It is another object of the present invention to provide an electrical connector, which has a plurality of communication terminals, each having a concave inner surface with a protrusion on the concave inner surface. By taking advantage of the cylindrical shape of the plug and the provision of the protrusion, the plug can be smoothly operated.

The various objects and advantages of the present invention will be more readily understood from the following detailed description when read in conjunction with the appended drawing, in which:

DETAILED DESCRIPTION OF THE INVENTION

Figure 1:
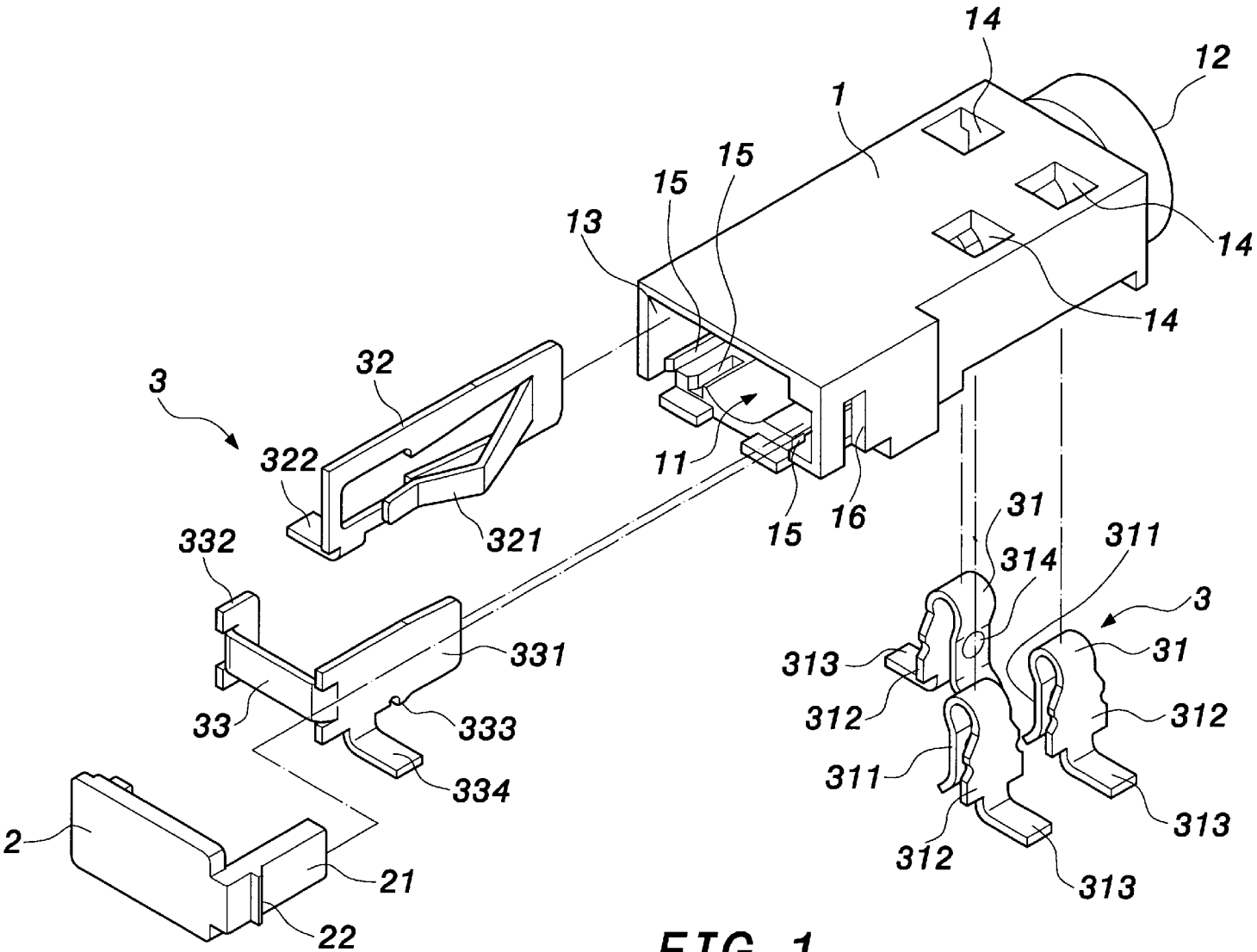
FIG. 1 is the exploded view of the present invention.

FIG. 1 shows the exploded view of the present invention. The electrical connector according to the present invention comprises an insulating main body 1, a rear cover 2 and a plurality of terminal set 3. The main body 1 is of lengthwise shape and has an insertion slot 11 through the front and back ends of the main body 1. The front end of the insertion slot 11 has a connection opening 12 for a plug (not shown). The back end of the insertion slot 11 has an embedding opening 13 fit the shape of the rear cover 2.

Moreover, a plurality of embedding holes 14 are provided on front portion of the insertion slot 11 and through the top side and bottom side of the main body 1. The embedding holes 14 are provided to retain a plurality of communication terminals 31 of the terminal set 3. The embedding opening 13 has a plurality of trenches 15 extended inner side of the insertion slot 11 and used for the embedding connection of switch terminals 32 and 33 of the terminal set 3. Moreover, the main body 1 has a dent 16 on rear sidewall thereof to lock with the rear cover 2 when the rear cover 2 is embedded to the embedding opening 13. Therefore, by the provision of the embedding holes 14, the trenches 15 and the dent 16, the terminal set 3 can be directly mounted on the main body 1 by embedding. Moreover, the rear cover 2 can also be easily assembled to the main body 1 by embedding.

Figure 2:
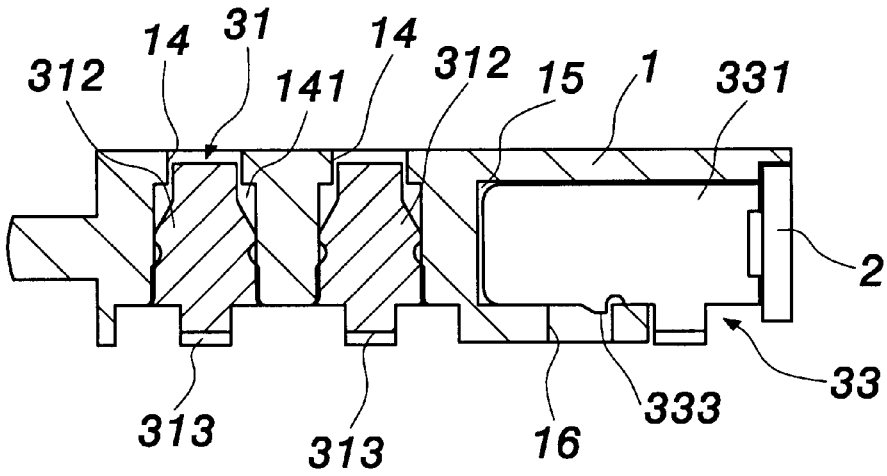
FIG. 2 is a sectional top view showing that the terminals are assembled.

The terminal set 3 not only can be easily assembled but also has stable mounting, wherein the communication terminals 31 are fit to the embedding holes 14. The communication terminal 31 has a large-angle bending elastic contact arm 311 on front end thereof. The communication terminal 31 further has a fixing part 312 bridging the elastic contact arm 311 and a soldering end 313 on distal end of the communication terminal 31 and electrically connected to a circuit board. The fixing part 312 is located on middle portion of the communication terminal 31 and is broadened tooth portion. The embedding hole 14 has an embedding groove 141 interfered with the fixing part 312 to retain the communication terminal 31 within the embedding hole 14, as shown in FIG. 2. The switch terminal 33 has shape of inversed "7" as shown in FIG. 1 and is composed a long insertion end 331 and a short insertion end 332 such that the switch terminal 33 can be easily inserted into the insertion slot 11 through the trench 15. Moreover. The long insertion end 331 of the switch terminal 33 has a clamping bump 333 on bottom end thereof.

Figure 3:
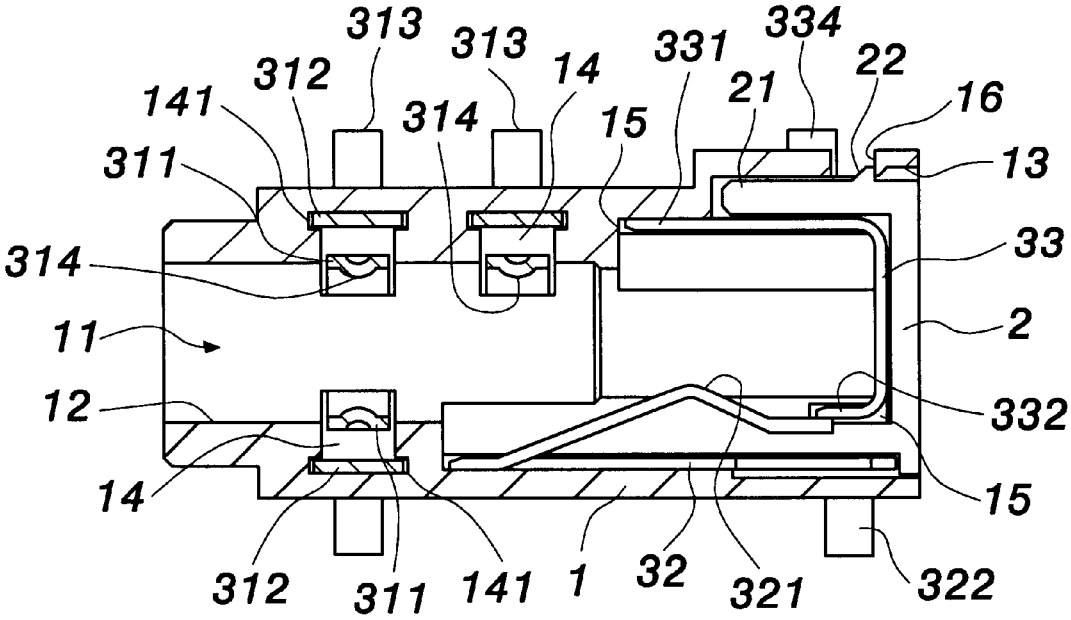
FIG. 3 is a sectional view of the present invention.

When the switch terminal 33 is inserted into the insertion slot 1, the long insertion end 331 is located at the same side as the dent 16. The clamping bump 333 is locked to the bottom end of the dent 16 as shown in FIG. 2. Therefore, the inserted switch terminal 33 can be stably fixed. Moreover, another switch terminal 32 has bent elastic contact arm 321 formed by directly pressing such that the switch terminal 32 is inserted into the insertion slot 11 along the trenches 15. Afterward, the rear cover 2 of the main body 1 is locked onto the main body 1 to stably retain the switch terminal 32. As shown in FIG. 3, the rear cover 2 has a long insertion tab 21 with a hook 22 on outer side thereof, and the rear cover 2 has shape matching with that of the switch terminal 33. The hook 22 can be locked on the dent 16 such that the switch terminals 32 and 33 are firmly retained into the insertion slot 11, wherein the bent elastic contact arm 321 of the switch terminal 32 is interfered with and electrically connected to the short insertion end 332 of the switch terminal 33. Moreover, the switch terminals 32 and 33 are electrically connected to the circuit board through respective solder ends 322 and 334 such that the switch terminals 32 and 33 can provide the function of switch for connecting or breaking circuit.

Figure 4:
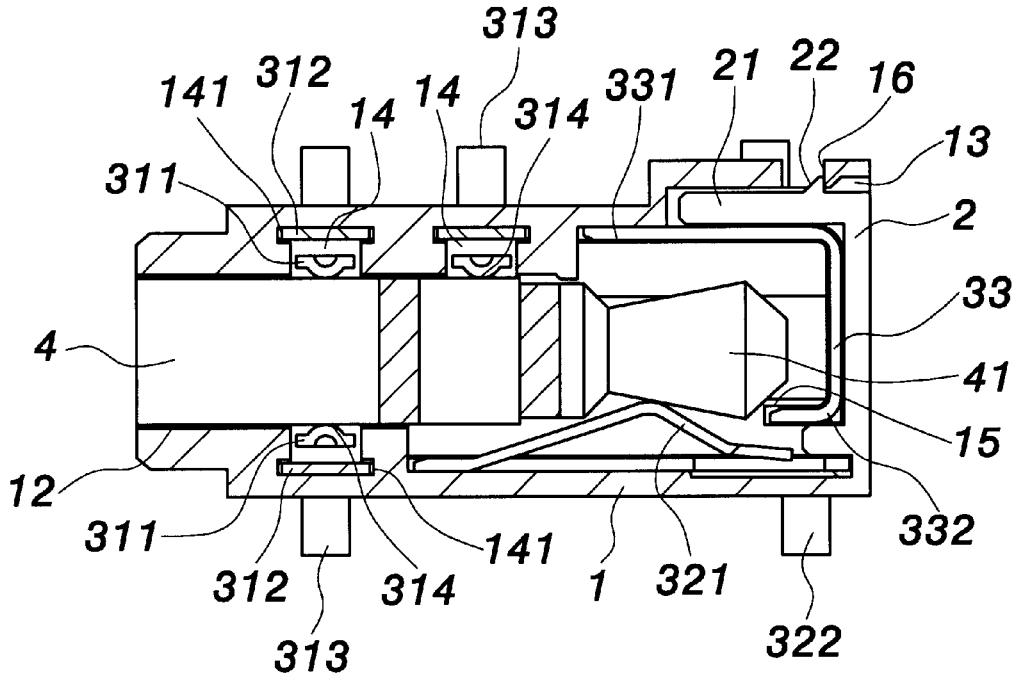
FIG. 4 shows an application of a preferred embodiment of the present invention.

FIG. 4 shows the operation of a preferred embodiment of the invention. When the plug 4 of an electrical connector is inserted into a specific position in the insertion slot 11, the head 41 of the plug 4 break the connection between the bent elastic contact arm 321 of the switch terminal 32 and the short insertion end 332 of the switch terminal 33. The switch of the connector is controlled by the insertion and extraction of the plug 4.

Figure 5:
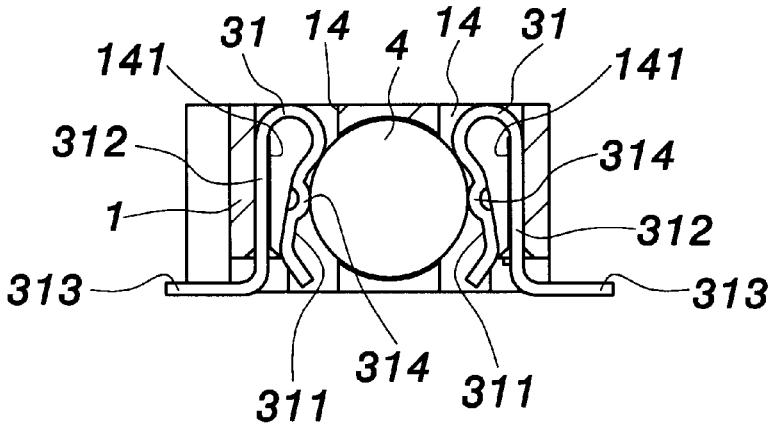
FIG. 5 shows the connection between communication terminal and a plug.
Figure 6:
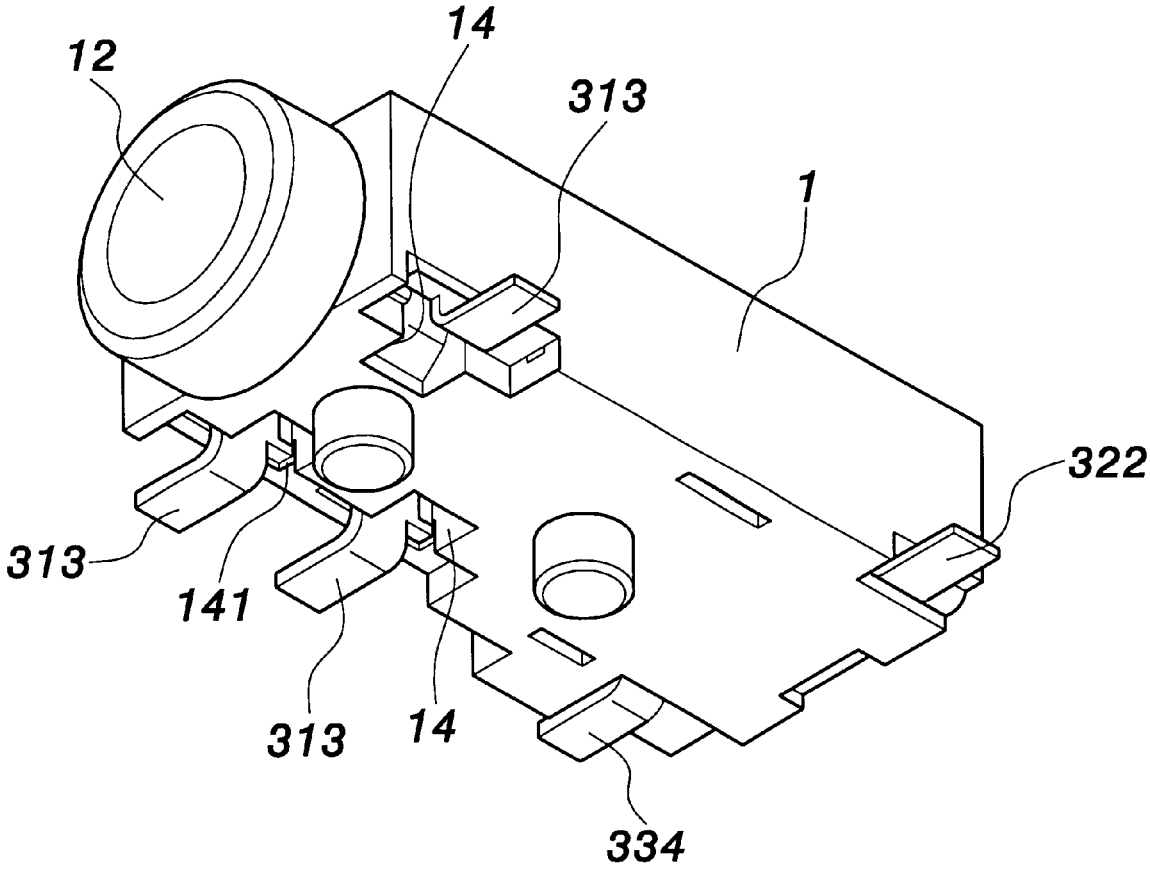
FIG. 6 is a perspective view of the present invention.

It should be noted that the communication terminal 31 has a large-angle bending elastic contact arm 311 on front end thereof. The large bending of the elastic contact arm 311 provides the communication terminal 31 with excellent deform elasticity. Moreover, the elastic contact arm 311 has a concave inner surface with a protrusion 314 on the concave inner surface. The enhanced elasticity of the large-angle bending elastic contact arm 311 retains firmly the inserted plug 4. Moreover, the concave shape of the inner surface of the bending elastic contact arm 311 and the cylindrical shape of the plug 4 further facilitates the retaining of the plug 4 in the insertion slot 11, as shown in FIG. 5. The bending elastic contact arm 311 is in contact with the plug 4 through the protrusion 314 on the concave inner surface thereof, the interference between the protrusion 314 and the plug 4 is very small. The plug 4 has smooth insertion and extraction operation, and the conductive material coated on surface of the elastic contact arm 311 will not be worn out. FIG. 6 shows the overall configuration of the electrical connector according to the present invention, the electrical connector has easy assembling and firm connection.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An electrical connector comprising an insulating main body, a rear cover and a plurality of terminals, the insulating main body having an insertion slot through the front and rear ends of the main body; wherein one end of the insertion slot having a connection opening at the front end of the main body for receiving a mating plug; a plurality of embedding holes provided on predetermined portion of the insertion slot and through the top side and bottom side of the main body; another end of the insertion slot having an embedding opening at the rear end of the main body; the embedding opening having a plurality of trenches extended into inner side of the insertion slot; the main body having a dent on rear sidewall thereof;

a rear cover having shape fitting with the embedding opening; the rear cover having a long insertion tab extending toward the insertion slot and having a hook on outer side thereof;

the plurality of terminals comprising a set of communication terminals and a set of switch terminals; the communication terminal having a large-angle bending elastic contact arm; the elastic contact arm having a concave inner surface with a protrusion on the concave inner surface; one of the switch terminals having the shape of inversed "7" and composed a short insertion end and a long insertion end;

the communication terminals being embedded into and retained by the embedding holes; the switch terminals being inserted into and retained by the trenches; the rear cover being embedded into the embedding opening and the hook on the long insertion tab locked into the dent to further retain the switch terminals.

2. The electrical connector as in claim 1, wherein the embedding hole has an embedding groove, and the communication terminal has broadened tooth portion on middle portion thereof; the broadened tooth portion is embedded into the embedding groove to further retain the communication terminal.

3. The electrical connector as in claim 1, wherein the long insertion end and short insertion end of the switch terminal of inversed "7" shape can be easily inserted into the insertion slot; the long insertion end having a clamping bump on bottom end thereof; the clamping bump locked to the bottom end of the dent.

4. The electrical connector as in claim 1, wherein the long insertion end of the other switch terminal has a bent elastic contact arm formed by directly pressing; the bent elastic contact arm interfered with and electrically connected to the short insertion end of the switch terminal of inversed "7" shape when the switch terminals are inserted into the insertion slot.

* * * * *